US009509076B2

(12) United States Patent
Hashimoto

(10) Patent No.: US 9,509,076 B2
(45) Date of Patent: Nov. 29, 2016

(54) CONNECTOR WITH FRONT BACKLASH PREVENTING PORTIONS AND REAR BACKLASH PREVENTING PORTION THAT ARE OFFSET CIRCUMFERENTIALLY WITH RESPECT TO THE FRONT BACKLASH PREVENTING PORTIONS

(71) Applicant: Sumitomo Wiring Systems, Ltd., Yokkaichi, Mie (JP)

(72) Inventor: Youjirou Hashimoto, Mie (JP)

(73) Assignee: SUMITOMO WIRING SYSTEMS, LTD, Yokkaichi, Mie (JP)

( * ) Notice: Subject to any disclaimer, the term of this patent is extended or adjusted under 35 U.S.C. 154(b) by 0 days.

(21) Appl. No.: 14/699,147

(22) Filed: Apr. 29, 2015

(65) Prior Publication Data

US 2015/0333430 A1 Nov. 19, 2015

(30) Foreign Application Priority Data

May 16, 2014 (JP) ..... 2014-101932

(51) Int. Cl.
*H01R 13/514* (2006.01)
*H01R 13/422* (2006.01)

(52) U.S. Cl.
CPC ..... *H01R 13/4223* (2013.01); *H01R 13/422* (2013.01)

(58) Field of Classification Search
CPC ..... H01R 13/4223; H01R 13/422
USPC ..... 439/752
See application file for complete search history.

(56) References Cited

U.S. PATENT DOCUMENTS 4,698,030 A * 10/1987 Ryll ..... H01R 13/436 439/732

FOREIGN PATENT DOCUMENTS

JP 2009-064719 3/2009

* cited by examiner

*Primary Examiner* — Javaid Nasri
(74) *Attorney, Agent, or Firm* — Gerald E. Hespos; Michael J. Porco; Matthew T. Hespos

(57) ABSTRACT

It is aimed to suppress backlash between a receptacle and a connector main body without reducing the operability of a connector connecting operation. Backlash preventing portions (70) project on an outer peripheral surface of a connector main body (10) to be fitted into a mating receptacle (92). The backlash preventing portions (70) include circumferentially spaced front backlash preventing portions (71) on a front part of the connector main body (10) in a fitting direction into the receptacle (92) and circumferentially spaced rear backlash preventing portions (72) on a rear part of the connector main body (10) in the fitting direction into the receptacle (92). The respective front and rear backlash preventing portions (71, 72) are separated in a front-back direction without being connected to each other and are displaced from each other in the circumferential direction.

4 Claims, 9 Drawing Sheets

CONNECTOR WITH FRONT BACKLASH PREVENTING PORTIONS AND REAR BACKLASH PREVENTING PORTION THAT ARE OFFSET CIRCUMFERENTIALLY WITH RESPECT TO THE FRONT BACKLASH PREVENTING PORTIONS

BACKGROUND

1. Field of the Invention

The invention relates to a connector.

2. Description of the Related Art

Japanese Unexamined Patent Publication No. 2009-64719 discloses a connector with a female housing that has a block-like main body. A range of the main body from the front surface to the outer peripheral surface is formed by a removable cap. The female housing can fit into a receptacle of a mating male housing. A total of eight inner ribs project at circumferential intervals on the outer peripheral surface of the cap. Each inner rib contacts the inner peripheral surface of the receptacle when the male and female housings are connected properly to restrict backlash between the receptacle and the main body.

Insertion force caused by relative sliding movements of the receptacle and the inner ribs in the process of connecting the housings increases if the inner ribs are provided over the entire length of the cap in a front-back direction and thus decreases operability. On the other hand, if the inner ribs are provided only on a part of the cap in the front-back direction, e.g. only on a front part of the cap so as to contact a back side of the inner peripheral surface of the receptacle, a rear end part of the cap may incline in the receptacle in association with vibration of a wire or the like. Thus, it may not be possible to suppress backlash between the receptacle and the main body portion.

The invention was completed based on the above situation and aims to suppress backlash between a receptacle and a connector main body without reducing the operability of a connector connecting operation.

SUMMARY OF THE INVENTION

The invention is directed to a connector, including a connector main body to be fit into a mating receptacle and backlash preventing portions that project on an outer peripheral surface of the connector main body. Each backlash preventing portion can suppressing backlash between the receptacle and the connector main body by contacting an inner peripheral surface of the receptacle. The respective backlash preventing portions include front backlash preventing portions arranged at circumferential intervals on a front end of the connector main body in a fitting direction into the receptacle and rear backlash preventing portions arranged at circumferential intervals on a rear end of the connector main body. The front backlash preventing portions and the rear backlash preventing portions are separated in a front-back direction without being connected to each other and are displaced from each other in the circumferential direction.

The separation of the front and rear backlash preventing portions in the front-back direction reduces an insertion force due to relative sliding movements of the receptacle and the respective backlash preventing portions. Thus, operability during connection is improved as compared with the case where these backlash preventing portions are connected to each other. Further, the connector main body is unlikely to incline in the front-back direction in the receptacle as compared with the case where the backlash preventing portions are composed only of the front backlash preventing portions or the rear backlash preventing portions, and backlash is suppressed reliably. In addition, the front and rear backlash preventing portions are displaced from each other in the circumferential direction, and can be molded easily by molds that are pulled out both forward and backward and difficulty in molding is solved.

The connector main body may include a housing into which a terminal fitting is to be mounted and a cap-shaped front member to be mounted on the housing to cover a front surface of the housing in the fitting direction and an outer peripheral surface of the housing. Each backlash preventing portion projects on an outer peripheral surface of the front member. The front member has a relatively simpler structure than the housing. Thus, a degree of freedom in molding each backlash preventing portion can be improved.

Each front backlash preventing portion is arranged on a front part of the connector main body in the fitting direction and each rear backlash preventing portion is arranged on a rear part of the connector main body in the fitting direction. Accordingly, a separating distance in the front-back direction between the respective front backlash preventing portions and the respective rear backlash preventing portions can be maximized and the inclination of the connector main body in the receptacle is more reliably suppressed.

DETAILED DESCRIPTION

An embodiment of the invention is described with reference to FIGS. 1 to 9. A connector of this embodiment includes a connector main body 10 and is connectable to a mating housing 90. The connector main body 10 includes a housing 20 and a front member 50 to be mounted on the housing 20. Note that, in the following description, ends of the housing 20 and the mating housing 90 that face each other at the time of starting connection are referred to as front ends concerning a front-back direction and a vertical direction is based on the respective figures except FIGS. 7 and 8. Further, a width direction is synonymous with a lateral direction of FIGS. 4 and 6.

Figure 1:
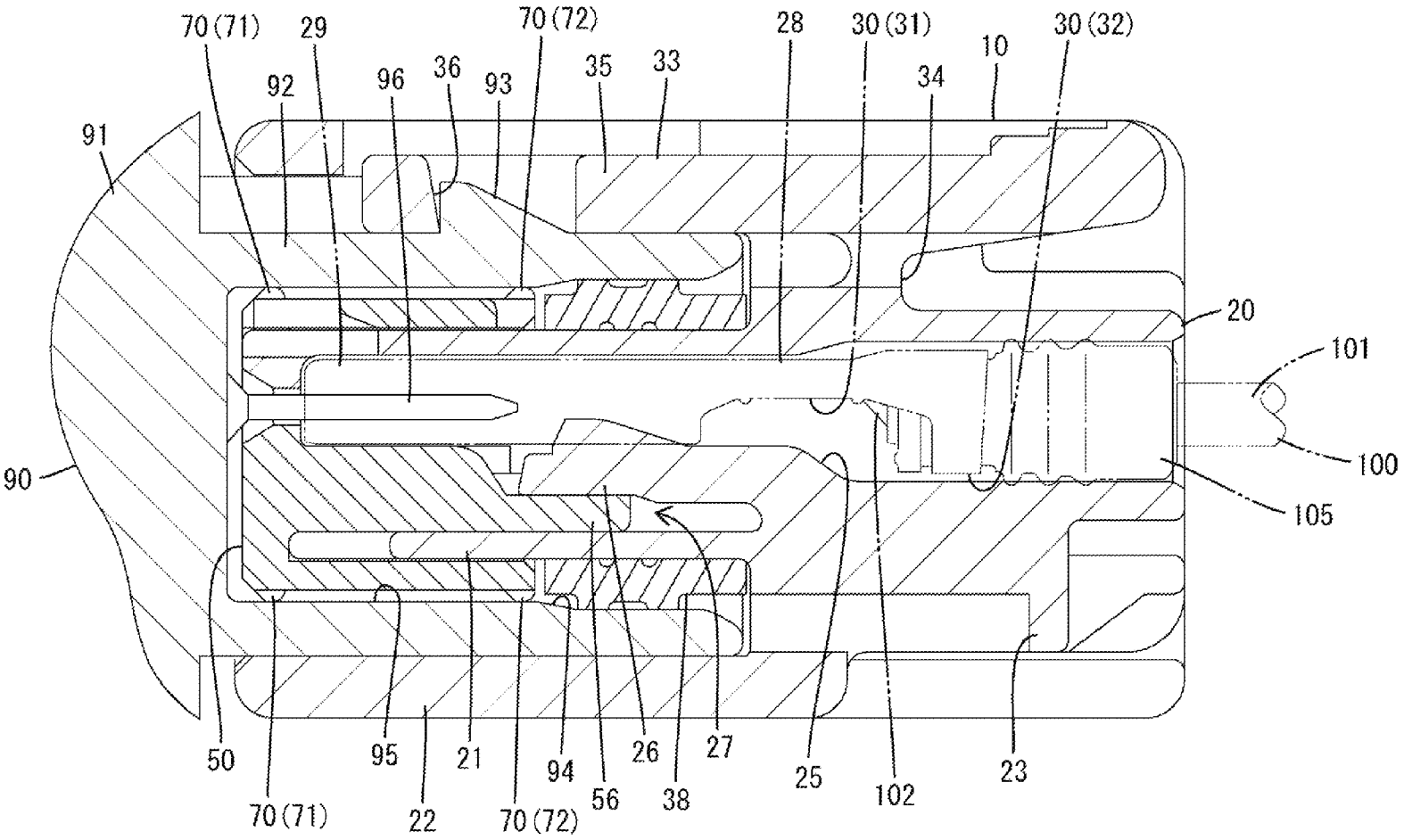
FIG. 1 is a section showing a state where a connector main body is fit to a proper depth in a receptacle in a connector of an embodiment of the invention.
Figure 2:
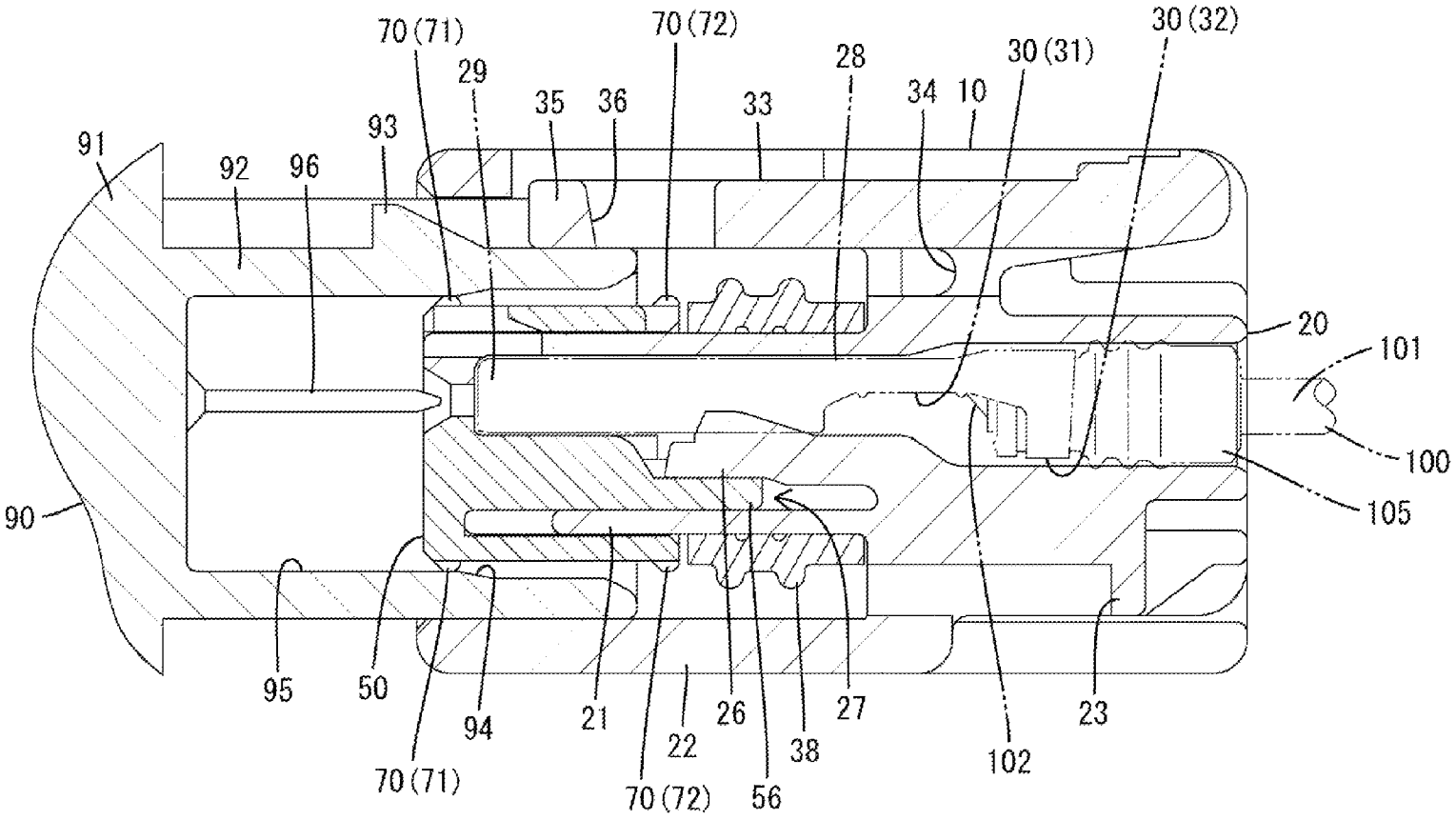
FIG. 2 is a section showing an intermediate state of fitting the connector main body into the receptacle.

The mating housing 90 is made of synthetic resin and includes a receptacle 92 directly connected to a device 91 and projecting forward, as shown in FIGS. 1 and 2. The receptacle 92 is a substantially rectangular tube and a lock projection 93 is provided on the upper surface of the upper wall. The receptacle 92 has an inclined surface 94 inclined to reduce a thickness of the receptacle 92 toward a back side at an intermediate position of the inner peripheral surface in a front-back direction, specifically at a position slightly before a center of the inner peripheral surface in the front-back direction. The inner peripheral surface of a part of the receptacle 92 behind the inclined surface 94 is a straight surface 95 continuous in the front-back direction substantially without unevenness. Male tabs 96 (only one is shown) project into the receptacle 92.

Figure 5:
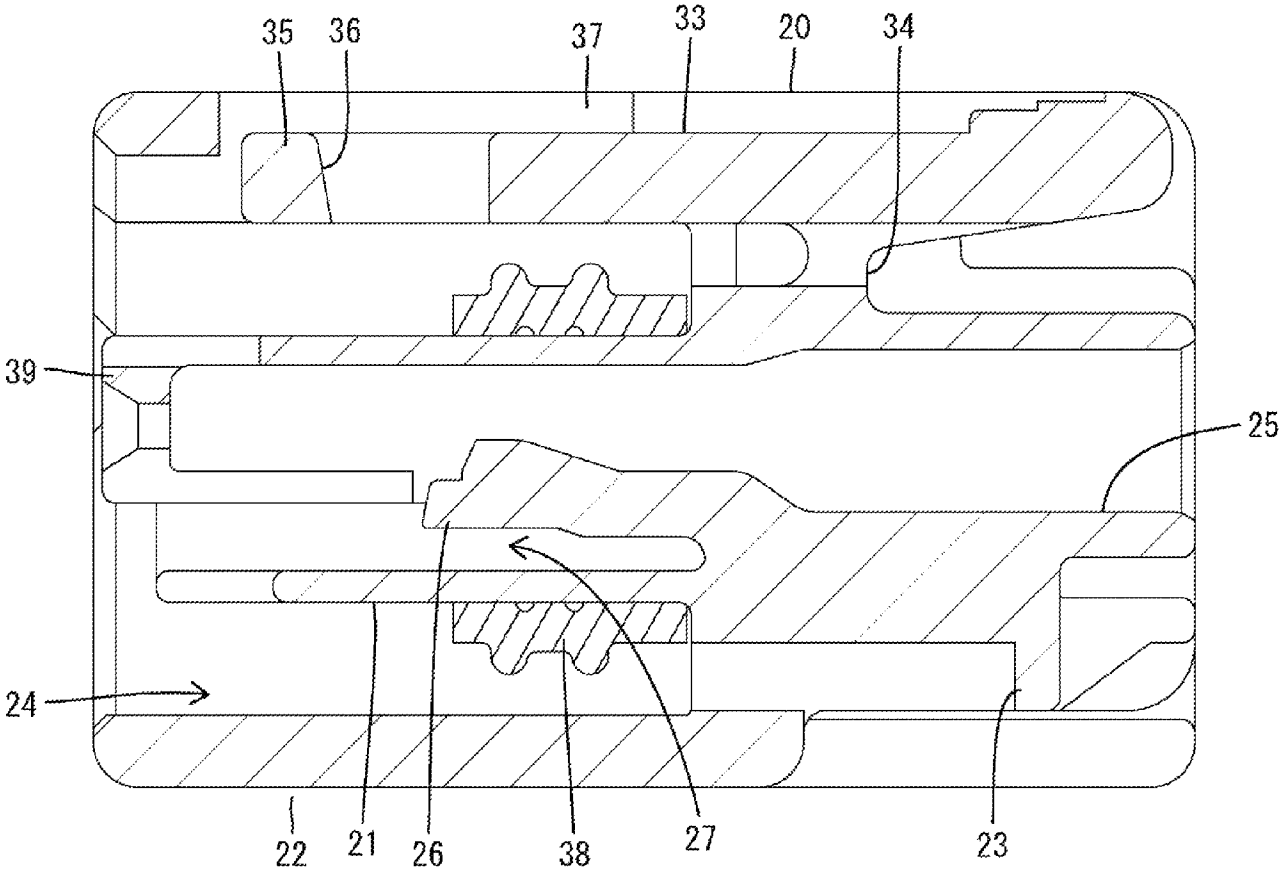
FIG. 5 is a section of a housing.

The housing 20 is made of synthetic resin and, as shown in FIG. 5, has a substantially block-like housing main body 21, a fitting tube 22 surrounding the outer periphery of the housing main body 21 and a radially extending coupling 23 linking the fitting tube 22 and the housing main body 21. A connection space 24 is open between the fitting tube 22 and the housing main body 21 and before the coupling 23 and can receive the mating receptacle 92.

Figure 4:
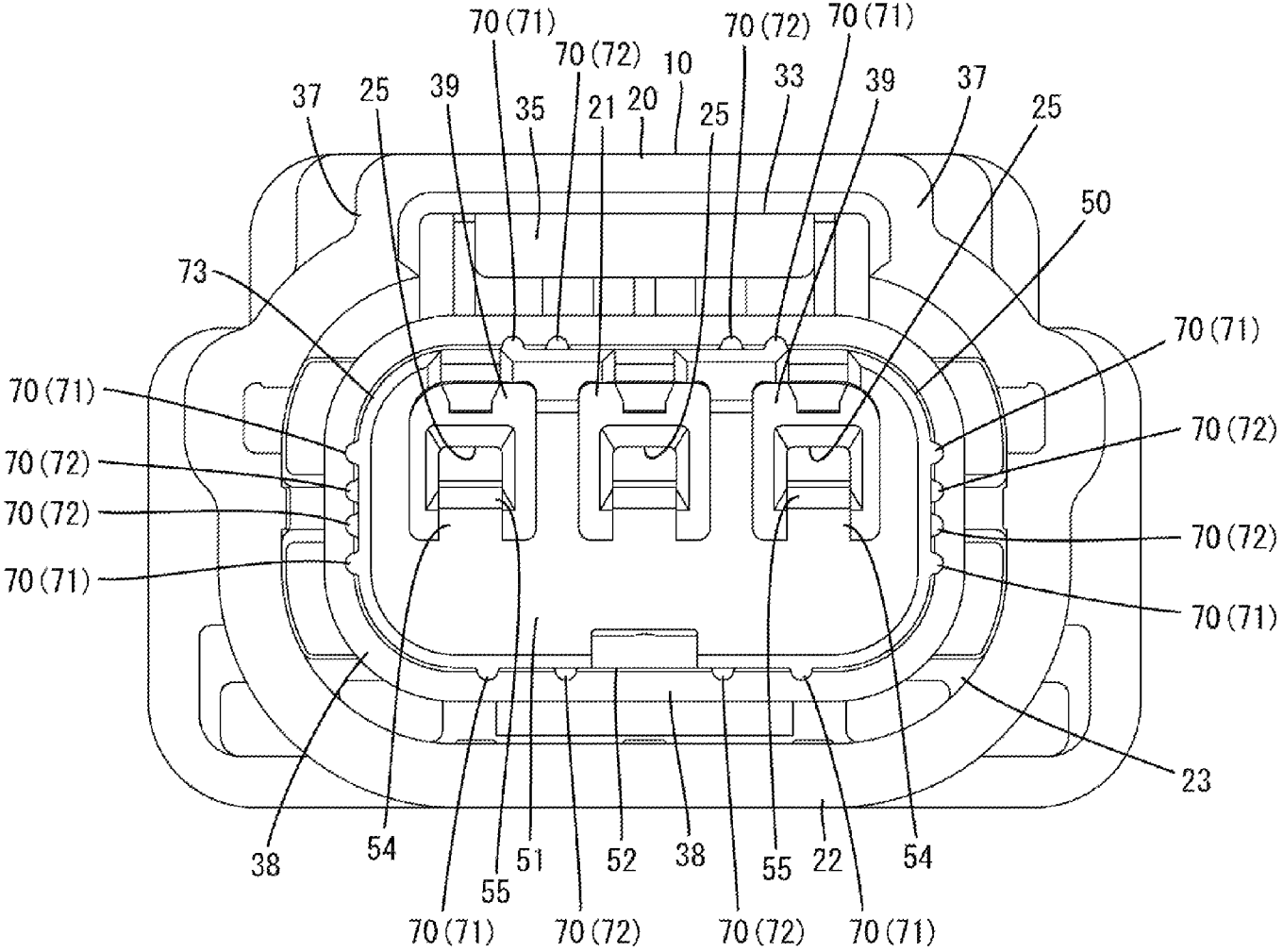
FIG. 4 is a front view of the connector main body.

Cavities 25 are provided side by side in a width direction in the housing main body 21, as shown in FIG. 4, and a locking lance 26 projects forward on the lower surface of the inner wall of each cavity 25, as shown in FIG. 5. The locking lance 26 is resiliently deformable with the rear end thereof as a support. A deflection space 27 for allowing the deflection of the locking lance 26 open forward between the lower surface of the inner wall of the cavity 25 and the locking lance 26.

As shown in FIGS. 1 and 2, a terminal fitting 28 is inserted into each cavity 25 of the housing main body 21 from behind and the locking lance 26 locks the properly inserted terminal fitting 28 in the cavity 25. The terminal fitting 28 is formed by bending an electrically conductive metal plate and includes a tubular body 29 and a barrel 30 behind the body 29. The mating male terminal 96 is inserted into the body 29 and connected when the two housings 20, 90 are connected. The barrel 30 is composed of a wire barrel 31 to be crimped into connection with an exposed core 102 at an end part of a wire 100 and an insulation barrel 32 to be connected to an insulating coating 101 and to a rubber plug 105 at the end part of the wire 100. The rubber plug 105 is held resiliently in close contact with the inner peripheral surface of a rear part of the cavity 25.

As shown in FIG. 5, a lock arm 33 is coupled to the housing main body 21. The lock arm 33 includes a leg 34 standing up from the upper surface of the housing main body 21 and an arm main body 24 extending both forward and backward from the upper end of the leg 34. A lock hole 36 vertically penetrates a front part of the arm main body 35. The arm main body 35 interferes with the lock projection 9 In the process of connecting the two housings 20, 903 and deforms resiliently with the leg 34 as a support. On the other hand, the arm main body 35 resiliently returns when the two housings 20, 90 are connected properly, and the lock projection 93 is fit into the lock hole 36. In this way, the two housings 20, 90 are held in a connected state. As shown in FIG. 4, protection walls 37 are provided on an upper end part of the fitting tube 22 at opposite sides of the lock arm 33 for covering opposite side surfaces of the lock arm 33.

A seal ring is fit on the outer peripheral surface of the housing main body 21 forward of the leg 34 and the coupling 23. As shown in FIG. 1, the seal ring 38 is sandwiched resiliently between the receptacle 92 and the housing main body 21 when the housings 20, 90 are connected properly. In this way, fluid-tight sealing is provided between the two housings 20, 90.

Figure 3:
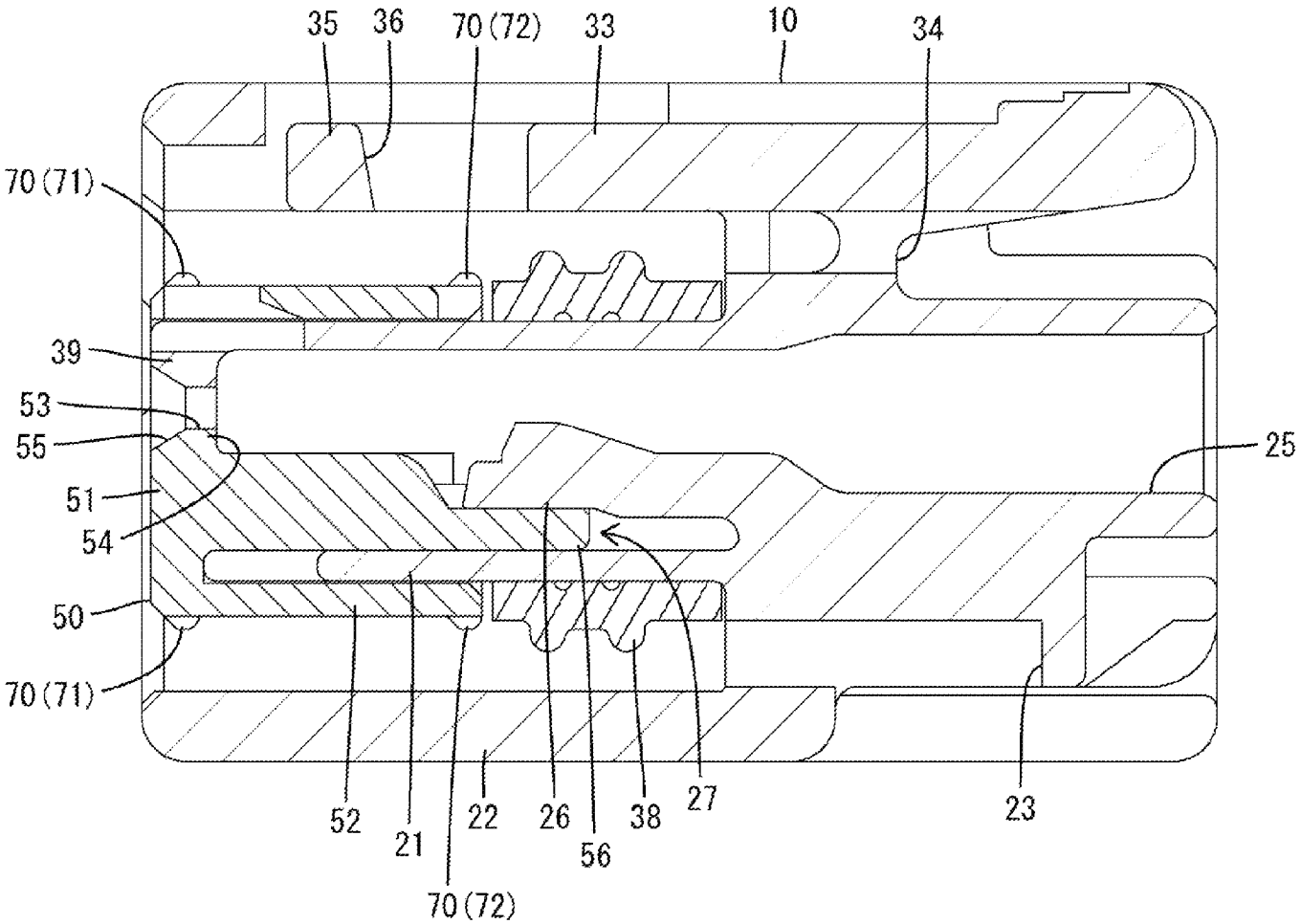
FIG. 3 is a section of the connector main body.

The front member 50 is made of synthetic resin and is cap-shaped as a whole. As shown in FIGS. 6 to 9, the front member 50 has a plate-like front wall 51 extending vertically and a peripheral wall 52 projecting back from the outer periphery of the front wall 51. As shown in FIGS. 3 and 4, the front member 50 is mounted onto the housing main body 21 from the front. When the front member 50 is mounted onto the housing main body 21, the front wall 51 covers the front surface of the housing main body 21 and the peripheral wall 52 covers the outer peripheral surface of the housing main body 21.

Figure 6:
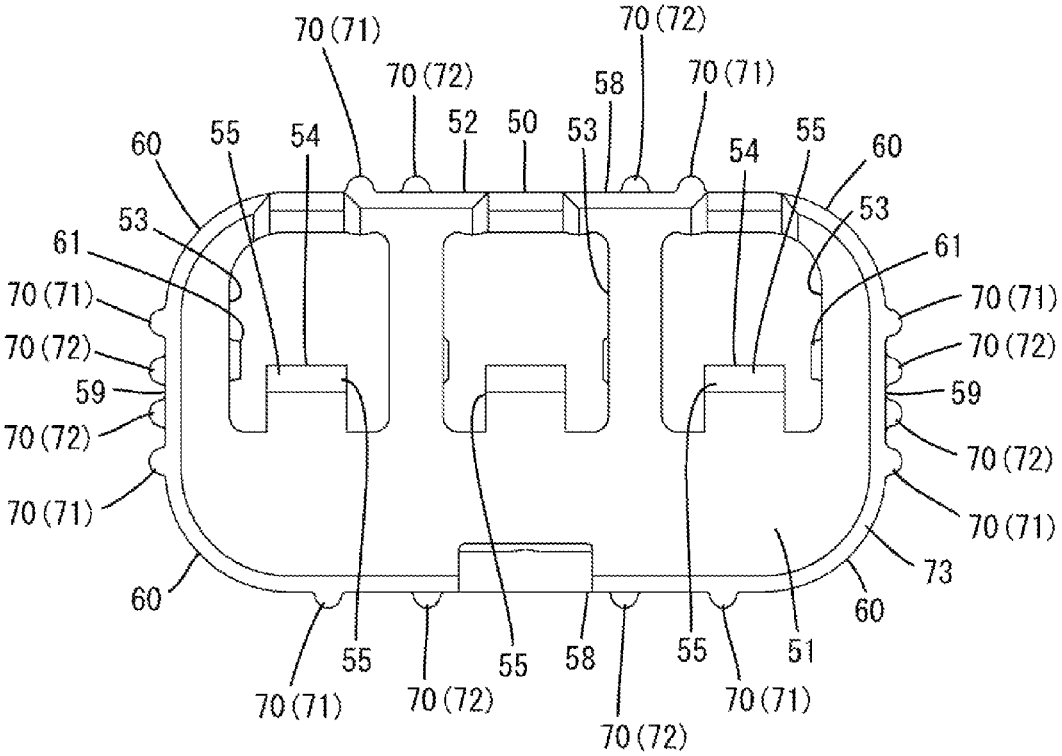
FIG. 6 is a front view of a front member.

The front wall 51 has laterally spaced windows 53, as shown in FIG. 6, and a front part 39 of each cavity 25 of the housing main body 21 can fit into each window 53, as shown in FIGS. 3 and 4. A protrusion 54 stand on the lower edge of the window 53, as shown in FIG. 6, and projects into the window 53 at a position forward of the locking lance 26, as shown in FIG. 3. Thus, when the front member 50 is mounted on the housing main body 21, the locking lances 26 are hidden behind the protrusions 54 and cannot be seen from the front (see FIG. 4). A tapered surface 55 is provided on a projecting tip of the protrusion 54 for guiding the mating male terminal 96 to the cavity 25.

Restricting portions are provided on the rear surface of the front wall 51 and project back from positions right below the respective windows 53, as shown in FIG. 3. Rear parts of the restricting portions 56 enter the deflection spaces 27 for the locking lances 26 to restrict deflection of the locking lances 26. Thus, the front member 50 has a retainer function and prevents the terminal fittings 28 from coming out of the cavities 25 by restricting the deflection of the locking lances 26.

As shown in FIG. 6, opposite upper and lower parts of the outer peripheral surface of the peripheral wall 52 define upper and lower long sides 58 that are wide in the width direction. On the other hand, opposite left and right parts of the outer peripheral surface of the peripheral wall 52 define short sides 59 that are short in a height direction. Further, parts of the outer peripheral surface of the peripheral wall 52 corresponding to four corners define curved portions 60 that link the long sides 58 and the short sides 59.

Locks 61 project on inner surfaces of the short sides 59 of the peripheral wall 52 (see FIG. 6). The respective locks 61 resiliently lock to the housing main body 21 When the front member 50 is mounted onto the housing main body 21 although not shown in detail. In this way, the front member 50 is prevented from being detached from the housing main body 21.

Figure 7:
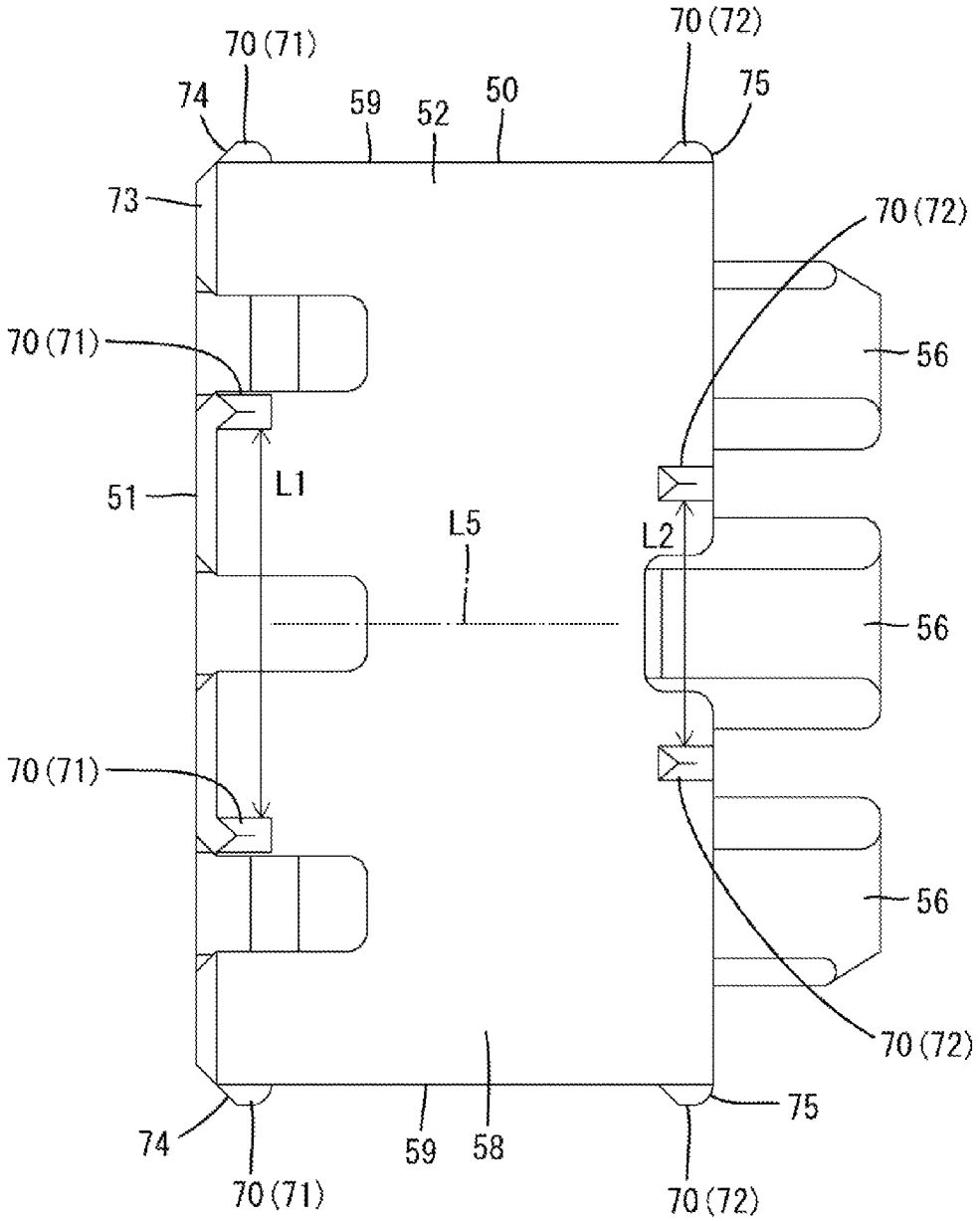
FIG. 7 is a plan view of the front member.
Figure 8:
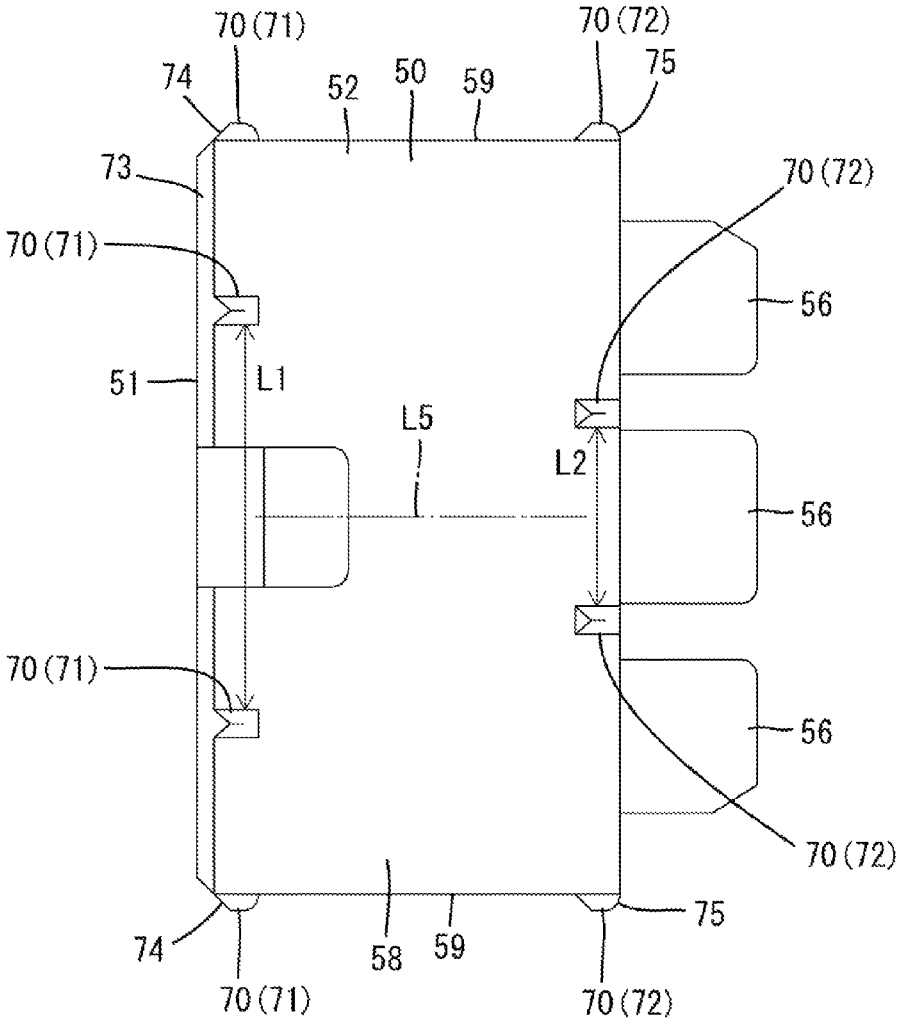
FIG. 8 is a bottom view of the front member.
Figure 9:
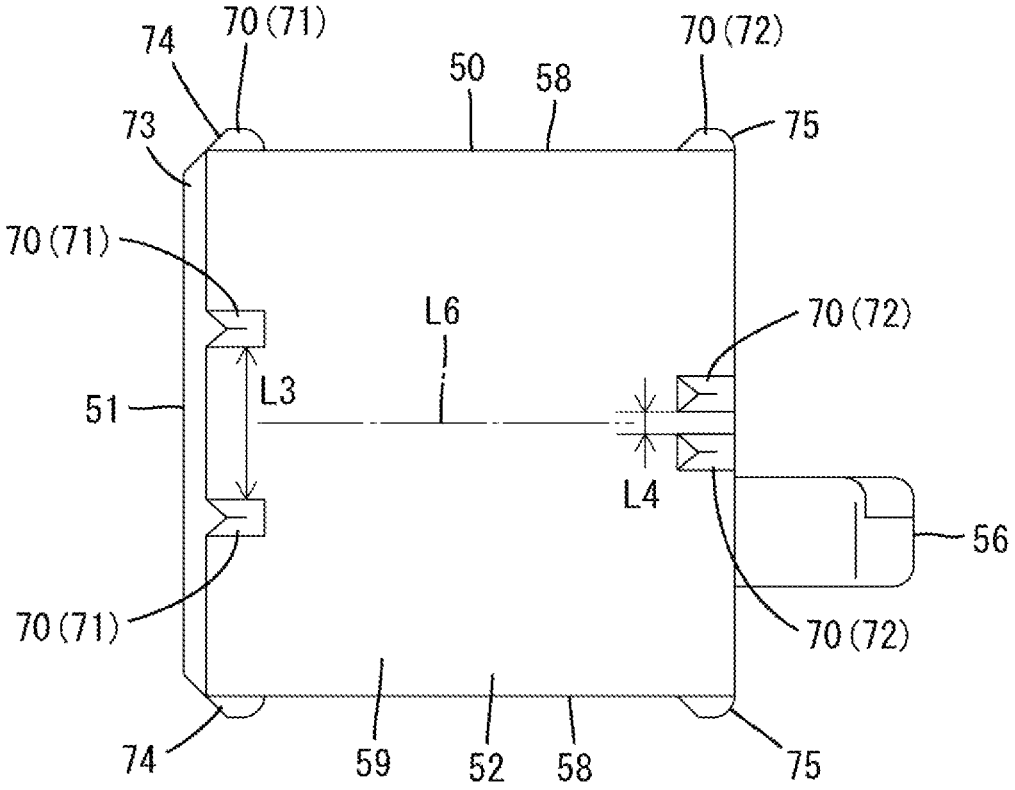
FIG. 9 is a side view of the front member.

As shown in FIGS. 6 to 9, backlash preventing portions 70 project on the outer peripheral surface of the peripheral wall portion 52. The backlash preventing portions 70 are arranged at intervals in the circumferential direction on the outer surface of the peripheral wall 52. Specifically, as shown in FIG. 6, the backlash preventing portions 70 are arranged at intervals in the width direction on the long sides 58 of the peripheral wall 52 and arranged at intervals in the height direction on the short sides 59 of the peripheral wall 52. Further, as shown in FIGS. 7 to 9, each backlash preventing portion 70 is a rib extending a short distance in the front-back direction. A cross-section of each backlash preventing portion 70 cut along a direction perpendicular to the front-back direction has a curved surface shape (see FIG. 6).

As shown in FIGS. 7 to 9, the backlash preventing portions 70 are arranged in a separated manner on a front part and a rear part of the outer surface of the peripheral wall portion 52 without being continuous in the front-back direction. The backlash preventing portions 70 on the front part of the outer surface of the peripheral wall 52 define front backlash preventing portions 71 and those on the rear part of the outer surface of the peripheral wall 52 define rear backlash preventing portions 72. The front and rear backlash preventing portions 71 and 72 have substantially the same shape and size.

As shown in FIGS. 6 to 9, a tapered chamfer 73 is formed over the entire periphery on the front edge of the peripheral wall 52. As shown in FIGS. 7 to 9, the front surface of each front backlash preventing portion 71 is an inclined surface 74 continuous with the chamfer 73 at substantially the same angle of inclination as the chamfer 73. Further, the rear surface of each rear backlash preventing portion 72 is a curved surface 75 continuous with the rear edge of the peripheral wall portion 52 without a step.

As shown in FIG. 6, the respective front and rear backlash preventing portions 71 and 72 are displaced from each other in the circumferential direction. Thus, the front and rear backlash preventing portions 71, 72 do not overlap each other in a front view and a rear view. Specifically, a separating distance L1 between the front backlash preventing portions 71 adjacent to each other in the width direction exceeds a separating distance L2 between the rear backlash preventing portions 72 adjacent to each other in the width direction on the long sides 58 of the peripheral wall 52 as shown in FIGS. 7 and 8. The backlash preventing portions 70 provided on the long side portions 58 of the peripheral wall portion 52 are arranged substantially symmetrically at opposite sides of an imaginary line L5 extending along widthwise centers of the long sides 58. A separating distance L3 between the vertically adjacent front backlash preventing portions 71 on the short sides 59 of the peripheral wall 52 exceeds a separating distance L4 between the vertically adjacent rear backlash preventing portions 72 on the short sides 59 of the peripheral wall 52, as shown in FIG. 9. The backlash preventing portions 70 on the short sides 59 of the peripheral wall 52 are arranged substantially symmetrically at opposite sides of an imaginary line L6 extending along centers of the both short sides 59 in the height direction.

The terminal fittings 28 are inserted into the cavities 25 of the housing main body 21, and then the front member 50 is mounted onto the housing main body 21 (see FIGS. 1 to 3). A mounting operation of the front member 50 is not hindered if the terminal fittings 28 are inserted properly into the cavities 25 and the rear part of each restricting portion 56 is inserted into the deflection space 27 for the corresponding locking lance 26. The restricting portions 56 restrict deflection of the locking lances 26 when the front member 50 is mounted to a proper mounted position, and the terminal fittings 28 are retained reliably in the cavities 25. On the other hand, the rear part of the restricting portion 56 interferes with the corresponding locking lance 26 if the terminal fitting 28 is not inserted completely in each cavity 25, and the front member 50 cannot reach the proper mounted position. Thus, the terminal fittings 28 will not be left in the incompletely inserted state.

Subsequently, the connector main body 10 is fit into the mating receptacle 92. In the process of fitting the connector main body 10, the front backlash preventing portions 71 contact the straight surface 95, as shown in FIG. 2, before the terminal fittings 28 contact the mating male terminals 96. The connector main body 10 then is fit further, and the front backlash preventing portions 71 slide on the straight surface 95 of the receptacle 92. The terminal fittings 28 contact the mating male terminals 96 as the front backlash preventing portions 71 slide on the straight surface 95 of the receptacle 92. Additionally, the lock arm 33 interferes with the lock projection 93 and deforms resiliently. At this time, the contact of the front backlash preventing portions 71 with the straight surface 95 of the receptacle 92 restricts loose movement of the connector main body 10 in the receptacle 92. Thus, the terminal fittings 28 smoothly come into contact and the lock arm 33 is deflected smoothly.

The rear backlash preventing portions 72 contact the straight surface 95 of the receptacle 92 immediately before the connector main body 10 is fit to a proper depth into the receptacle 92. In the process of fitting the connector main body 10 into the receptacle 92, parts of the front member 50 that slide on the inner peripheral surface of the receptacle 92 (including the straight surface 95) are only the front backlash preventing portions 71.

The rear backlash preventing portions 72 contact a rear end part of the straight surface 95 of the receptacle 92 and the front backlash preventing portions 71 contact a part of the straight surface 95 of the receptacle 92 near the front end when the connector main body 10 is fit to a proper depth into the receptacle 92, as shown in FIG. 1. At this time, the front backlash preventing portions 71 and the rear backlash preventing portions 72 are in contact with the straight surface 95 of the receptacle 92 without being squeezed. Further, a part of the outer peripheral surface of the peripheral wall 52 of the front member 50 between the front and rear backlash preventing portions 71, 72 is kept out of contact with the inner peripheral surface of the receptacle 92. The two housings 20, 90 are connected properly when the connector main body 10 is fit to a proper depth into the receptacle 92. The lock arm 33 holds the housings 20, 90 in the connected state with the terminal fittings 28 electrically conductively connected to the mating male terminals 96.

Backlash between the receptacle 92 and the connector main body 10 may be caused by vibration of the device 91 and causes the terminal fittings 28 and the male terminals 96 to slide against each other and abrade, thereby impairing connection reliability. However, both the front and rear backlash preventing portions 71 and 72 are in contact with the straight surface 95 of the receptacle 92 to prevent backlash between the receptacle 92 and the connector main body 10. More particularly, both the front and rear backlash preventing portions 71 and 72 are in contact with the straight surface 95 of the receptacle 92 while being spaced apart in the front-back direction. Thus, even if the wires 100 drawn out from the rear surface of the housing main body 21 are swung in a direction intersecting the front-back direction, the connector main body 10 will not incline. Therefore, backlash between the receptacle 92 and the connector main body 10 is suppressed reliably and the connection reliability of the terminal fittings 28 is ensured. Further, rattling sounds are not generated.

As described above, the front and rear backlash preventing portions 71 and 72 are spaced apart in the front-back direction. Thus, as compared with the case where these backlash preventing portions 71, 72 are long and narrow ribs continuous in the front-back direction, an insertion force due to relative sliding movements of the receptacle 92 and the backlash preventing portions 70 is low. Therefore, an operation burden during connection is reduced to improve operability.

The respective front and rear backlash preventing portions 71 and 72 are in contact with the inner peripheral surface of the receptacle 92 while being spaced apart in the front-back direction. Thus, inclination of the connector main body 10 in the front-back direction in the receptacle 92 is prevented. More particularly, since the respective front and backlash preventing portions 71 and 72 are provided on the opposite front and rear end parts of the outer surface of the peripheral wall 52 of the front member 50, the inclination of the connector main body 10 in the front-back direction in the receptacle 92 is prevented more reliably. Thus, backlash between the receptacle 92 and the connector main body 10 is suppressed more reliably.

In addition, the respective front and rear backlash preventing portions 71 and 72 are displaced in the circumferential direction on the outer peripheral surface of the connector main body 10. Thus, the backlash preventing portions 71, 72 can be molded easily by molds that are pulled out both forward and backward when the front member 50 is molded. Thus, molding difficulty is solved. Above all, since the respective front and rear backlash preventing portions 71 and 72 are provided on the front member 50, there is less restriction in molding and molding is improved as compared with the case where the backlash preventing portions 71, 72 are provided on the housing 20.

The invention is not limited to the above described embodiment. For example, the following modes are also included in the technical scope of the present invention.

The front member may be a front mask for covering the front surface of the housing main body without having the retainer function of preventing the terminal fittings from coming out of the cavities.

If the connector main body does not include the front member, the backlash preventing portions may project on the outer peripheral surface of the housing main body.

Both the front and rear backlash preventing portions may slide on the inner surface of the receptacle in the process of connecting the housings.

The projecting tip of each backlash preventing portion may be pointed. In this case, the projecting tip of each backlash preventing portion may be configured to be squeezed by contact with the inner peripheral surface of the receptacle.

LIST OF REFERENCE SIGNS

10 . . . connector main body
20 . . . housing
28 . . . terminal fitting
50 . . . front member
52 . . . peripheral wall portion
70 . . . backlash preventing portion
71 . . . front backlash preventing portion
72 . . . rear backlash preventing portion
90 . . . mating housing
92 . . . receptacle

What is claimed is:

1. A connector, comprising a connector main body to be fit into a mating receptacle and a plurality of backlash preventing portions projecting on an outer peripheral surface of the connector main body, each backlash preventing portion being capable of suppressing backlash between the receptacle and the connector main body by contacting an inner peripheral surface of the receptacle, wherein:

the backlash preventing portions include a plurality of front backlash preventing portions arranged at intervals in a circumferential direction on a front part of the connector main body in a fitting direction into the receptacle and a plurality of rear backlash preventing portions arranged at intervals in the circumferential direction on a rear part of the connector main body in the fitting direction into the receptacle; and the respective front backlash preventing portions and the respective rear backlash preventing portions are separated in a front-back direction without being connected to each other, the front backlash preventing portions being at a first plurality of circumferential positions and the rear backlash preventing portions being at a second plurality of circumferential positions that is different from the first plurality so that the front backlash preventing portions are displaced in the circumferential direction from the rear backlash preventing portions.

2. The connector of claim 1, wherein the connector main body includes a housing into which a terminal fitting is to be mounted and a cap-shaped front member to be mounted on the housing to cover a front surface of the housing in the fitting direction and an outer peripheral surface of the housing, the backlash preventing portions projecting on an outer peripheral surface of the front member.

3. The connector of claim 2, wherein each front backlash preventing portion is arranged on a front part of the connector main body in the fitting direction and each rear backlash preventing portion is arranged on a rear part of the connector main body in the fitting direction.

4. A connector, comprising a connector main body to be fit into a mating receptacle and a plurality of backlash preventing portions projecting on an outer peripheral surface of the connector main body, each backlash preventing portion being capable of suppressing backlash between the receptacle and the connector main body by contacting an inner peripheral surface of the receptacle, wherein:

the backlash preventing portions include a plurality of front backlash preventing portions arranged at intervals in a circumferential direction on a front part of the connector main body in a fitting direction into the receptacle and a plurality of rear backlash preventing portions arranged at intervals in the circumferential direction on a rear part of the connector main body in the fitting direction into the receptacle; and the respective front backlash preventing portions and the respective rear backlash preventing portions are separated in a front-back direction without being connected to each other, and the front backlash preventing portions being aligned in the front-back direction with the intervals between the rear backlash preventing portions.

* * * * *